United States Patent [19]

Carlessimo

[11] 4,109,425

[45] Aug. 29, 1978

[54] CIRCULAR TYPE MANHOLES

[76] Inventor: John J. Carlessimo, 29800 W. Eight Mile Rd., Farmington Hills, Mich. 48024

[21] Appl. No.: 749,810

[22] Filed: Dec. 13, 1976

[51] Int. Cl.[2] ..... E02D 29/14
[52] U.S. Cl. ..... 52/21; 404/25
[58] Field of Search ..... 52/19–21, 52/192, 249; 404/25, 26

[56] References Cited

U.S. PATENT DOCUMENTS

| | | | |
|---|---|---|---|
| 1,177,311 | 3/1916 | Flannery | 52/249 |
| 1,497,583 | 6/1924 | Peterson | 52/192 |
| 2,002,127 | 5/1935 | O'Neal | 52/20 |

FOREIGN PATENT DOCUMENTS

| | | | |
|---|---|---|---|
| 209,931 | 1/1924 | United Kingdom | 52/100 |

*Primary Examiner*—James L. Ridgill, Jr.
*Attorney, Agent, or Firm*—Hauke and Patalidis

[57] ABSTRACT

A manhole well structure for gaining access to an underground water main, a sewer pipe system or the like, which includes a preferably precast base, made of concrete or like material, which is disposed at an appropriate depth below the ground level. The base element has an appropriate thickness so as to provide a strong and sturdy base for the manhole well wall structure, and is provided with a generally centrally disposed transverse groove in which is disposed the water main or sewer conduit, and with an annular recess or groove formed proximate the periphery of the base and providing an anchoring and footing means for the bottom of the well wall.

2 Claims, 7 Drawing Figures

CIRCULAR TYPE MANHOLES

BACKGROUND OF THE INVENTION

The present invention relates to a well construction for manholes permitting access to underground conduits, such as water mains, sewer pipe systems, gas mains, conduits containing utility lines such as telephone and electrical lines, and the like.

In underground installations of pipe systems, manholes and appropriate manhole wells ae disposed at predetermined locations along the system for gaining access, for example, to valves, gates, taps, connections and the like for inspection. The top of the access wells is closed with a removable metallic lid, and the wall of the well is sometimes provided with a built-in ladder in the form of steel rungs or steps attached to the wall of the well. The wall itself may be precast of concrete or like material, or made of cast iron, or the like, casing. Alternatively, the well may be made of masonry construction. Whatever the structure adopted for the well construction, the well is generally circular or oval and is provided with an inverted frusto-conical section, having its smaller diameter portion disposed at the top and its widest diameter portion disposed toward the bottom, superimposed on a generally cylindrical portion of a predetermined height disposed at the bottom of the well to provide a working area for maintenance or installation personnel working on the underground system. The narrowest end of the well is normally obturated by a removable manhole cover flush with the pavement or with the ground surface.

A necessary requirement of a manhole well casing is that its wall be capable of supporting without collapsing the side load imposed thereon by the earth in which the well casing is buried. The casing walls and floor or base must be impervious to seepage of water in order to prevent flooding of the well. Furthermore, the floor or base of the well must be relatively sturdy so as to provide a strong support for a person working within the manhole well and, in addition to being impervious to seepage of water and mud through the floor or at the junction between the floor and the casing walls, the base must provide a strong footing for the bottom of the casing walls, and a sturdy support for the conduit or pipe running through the casing.

SUMMARY OF THE INVENTION

The present invention accomplishes its several objectives by providing a generally circular base member of a substantial thickness, made of concrete or the like material. The base member is preferably precast, and is provided with a circular groove formed proximate to the periphery of the base element for providing a strong and water impervious footing for the well wall bottom. The concrete base member is provided on its top with a generally diametrically disposed groove, transversely disposed, or a dimension suitable for nesting therein part of the periphery of a length of pipe or conduit of an underground pipe system.

BRIEF DESCRIPTION OF THE DRAWINGS

The many objects and advantages of the present invention will become readily apparent to those skilled in the art when the following description of the best mode contemplated for practicing the invention is read in conjunction with the accompanying drawing, wherein like reference numerals relate to like or equivalent parts throughout the several views, and in which.

DETAILED DESCRIPTION OF THE PREFERRED EMBODIMENT

Figure 1:
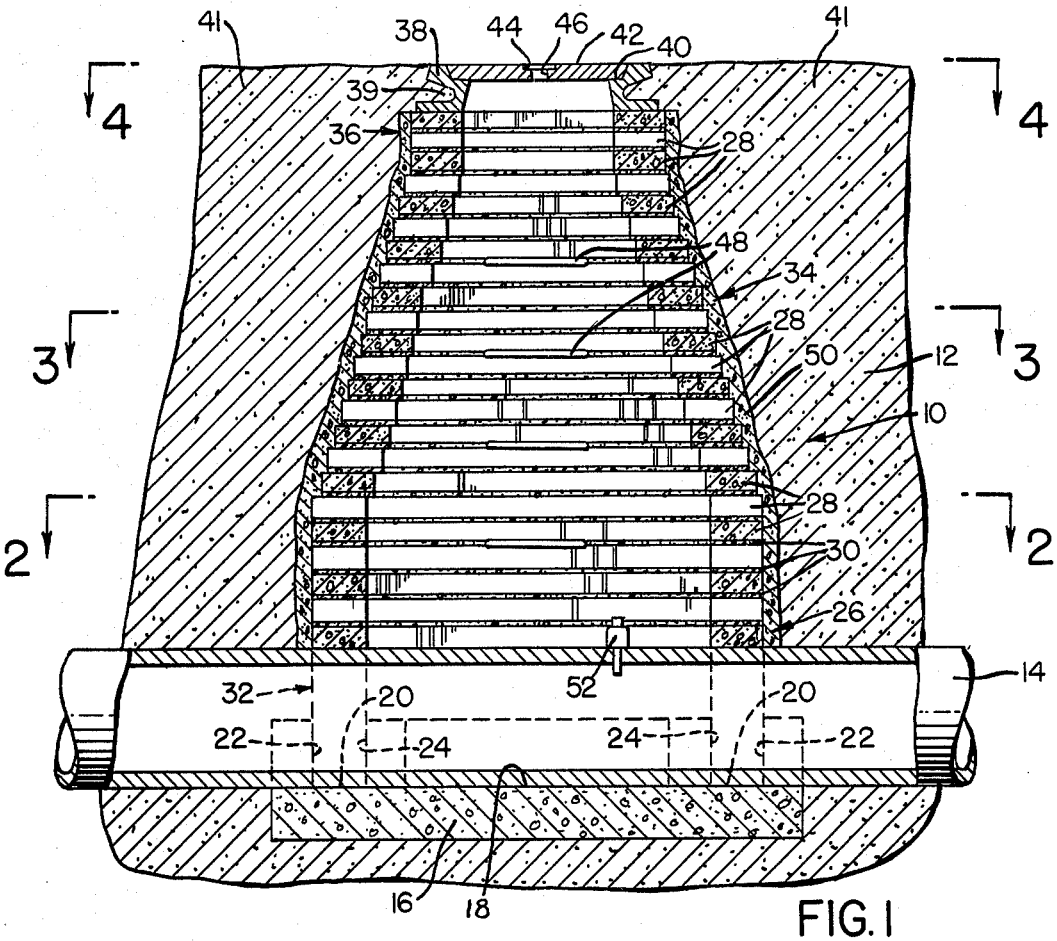
FIG. 1 is a vertical sectional view of an example of preferred structure for a manhole well according to the present invention.

Referring now to the drawing, a manhole well casing 10 according to the present invention is shown buried in the earth 12, with its longitudinal axis disposed substantially vertically. The manhole well casing provides access from the ground level to an underground conduit 14, such as a water main for example. Several such manhole well casings 10 are disposed at suitable intervals and locations along a water main system or the like, as may be required.

Figure 7:
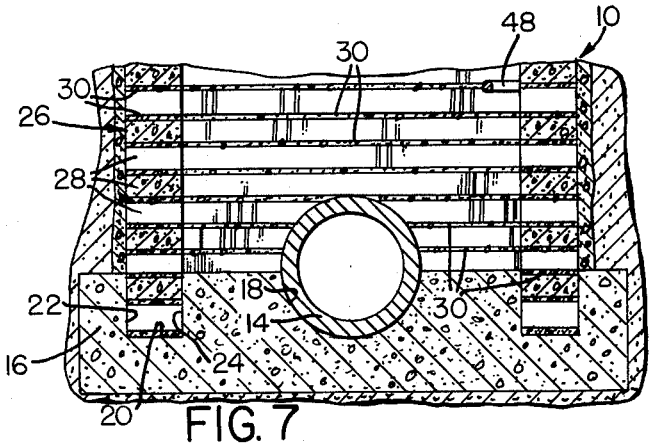
FIG. 7 is a partial cross-sectional view along line 7—7 of FIG. 2.
Figure 6:
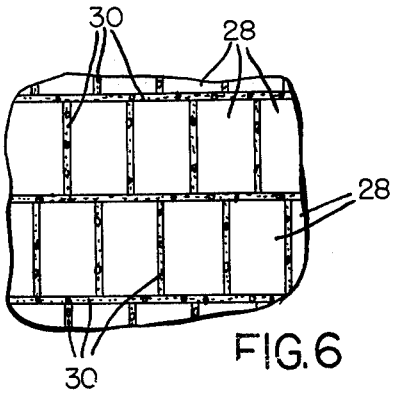
FIG. 6 is a partial elevational view from line 6—6 of FIG. 5.

The manhole well casing 10 is provided at its bottom end with a preferably massive base member 16 of an appropriate thickness, which may be cast in position in the excavation in which is disposed the pipe system prior to filling the excavation, or, alternatively and preferably which is precast of concrete or like material. The base member 16 is provided on its top with a transverse groove 18, best shown at FIGS. 1 and 7, formed on its top surface and which is adapted to partially surround the periphery of the conduit 14, thus providing a saddle or support for the conduit 14. A generally curvilinear annular groove 20 is formed on the top surface and proximate the periphery of the circular base member 16, thus defining a pair of concentric parallel spaced apart cylindrical walls 22 and 24. The annular groove 20 may be circular, or oval, or the like, but is preferably curvilinear.

Figure 2:
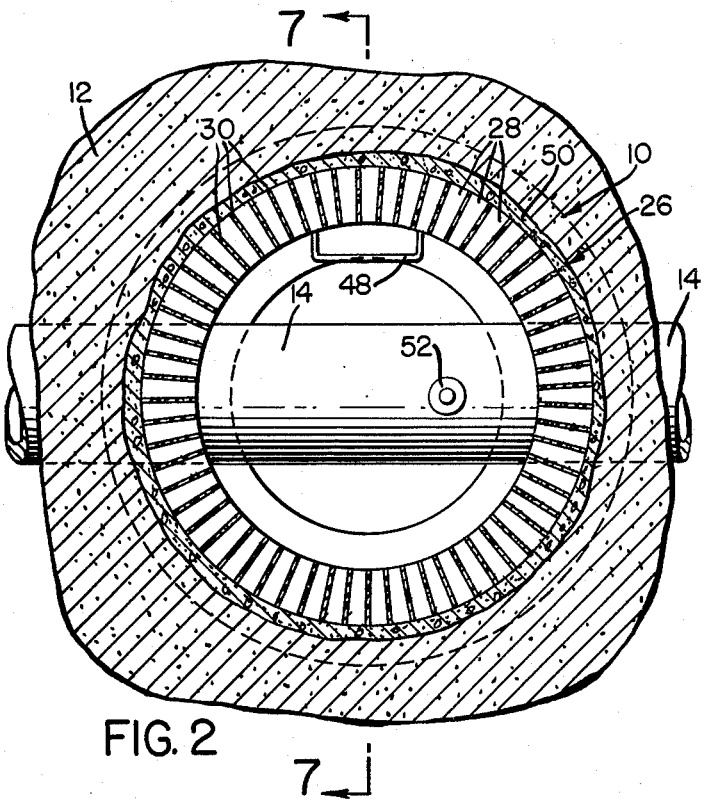
FIG. 2 is a transverse sectional view thereof along line 2—2 of FIG. 1.
Figure 3:
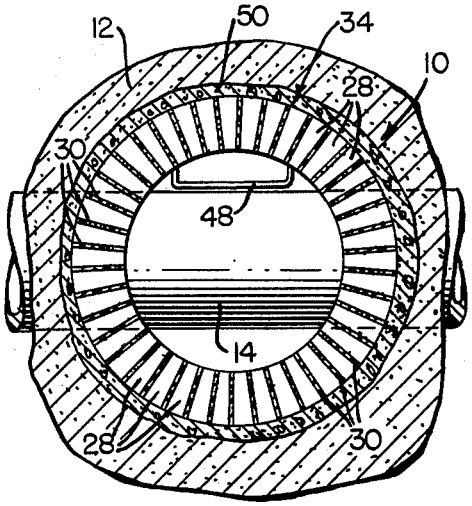
FIG. 3 is a transverse sectional view thereof along line 3—3 of FIG. 1.
Figure 4:
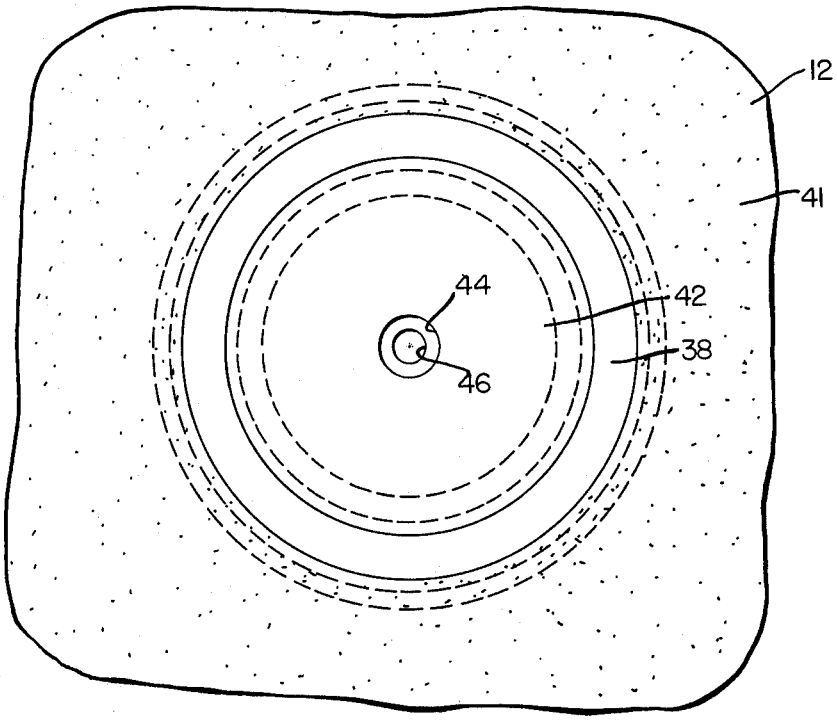
FIG. 4 is a top plan view thereof as seen from line 4—4 of FIG. 1.
Figure 5:
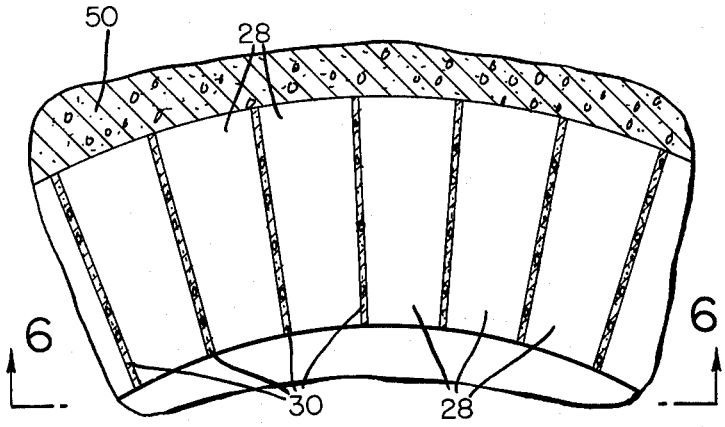
FIG. 5 is an enlarged partial view of the structure shown at FIG. 2.

The manhole well casing 10 has a generally curvilinear cylindrical wall 26 which, in the structure illustrated, is of masonry construction consisting or superimposed courses of tapered bricks 28 which are secured together, in the conventional manner, by mortar as shown at 30, disposed between consecutive courses and consecutive bricks 28 in each course. In the example of structure illustrated, and as best shown at FIG. 1, 11 such superimposed courses are disposed at the bottom portion of the well casing 10 such as to form a right cylindrical bottom section 32, the footing of which is disposed and mortared between the sidewalls 22 and 24 of the annular groove 20 in the base member 16. Above the lower cylindrical portion 32 of the well casing 10 is disposed a frusto-conical portion 34 which, in the example illustrated, consists of 14 superimposed courses of brick 28, each course disposed above a subjacent course having a predetermined lesser number of bricks such as to gradually regularly decrease the diameter of the well casing from the lower course to the upper course. In the example of well casing illustrated, a short right cylindrical small diameter portion 26 formed, for example as illustrated, of three superimposed courses of bricks 28 disposed above the frusto-conical portion 34 of the well casing. Different numbers of courses may obviously be used, and the casing 10, although shown as circular in transverse section (FIGS. 2 and 3), may be oval, or gradually evolve from an oval shape to a circular shape.

The top of the cylindrical reduced diameter portion, or neck portion 36 of the well casing 10, supports an annular metallic frame 38 made for example of steel or cast iron, and having a recessed seat 40 for a lid or cover 42 adapted to normally obturate the opening of the well casing 10. The periphery of the frame 38 has a V-shaped groove 39 into which projects part of the soil or pavement 41 which generally forms a layer on the top of the earth 12 in which the well casing 10 is buried. The manhole cover 42 has a removable plug 44 normally closing an aperture 46. The aperture 46 provides a means for anchoring an appropriate handle or lever, not shown, not tilting and manually removing the manhole cover 42 when it is desired to gain access to the interior of the well casing 10.

A ladder, formed of a plurality of steps or rungs 48 made of, for example, generally U-shaped metal rods having their ends sealed in the mortar layers 30 between consecutive courses of bricks 28, may be attached to the inside of the well 10 for allowing a person to conveniently gain access to the bottom of the well from the ground level, once the manhole cover 42 is removed.

A coating of concrete or mortar 50 is applied to the outer surface of the bricks 28, to increase the strength of the well casing 10 and to form an additional barrier preventing the seepage of water from the earth 12 surrounding the well casing to the interior of the well casing.

It will be appreciated that, in the example of structure illustrated, the water main or conduit 14 is provided inside the well casing 10 with for example an air-relief valve 52 or other device or control which can be reached only through descending into the manhole well casing. It will be appreciated that the illustrated and described example of application of a manhole well casing for inspection of underground conduits is given for illustrative purposes only. It will also be appreciated that prior to the well casing 10 being built at an appropriate location along a main water pipe or other conduit system, the base member 16 is cast in position at the bottom of the excavation, or preferably, a precast base member 16 is lowered to the bottom of the excavation before lying the conduits 14. After the well casing 10 is built up in position, the ditch or excavation is filled with fill dirt or earth 12, and appropriately compacted to support a pavement 41, or a sidewalk, or the like. It will also be appreciated that instead of the masonry structure illustrated and described for the well casing 10, a concrete or metal precast well casing may be dropped in position, with the bottom end thereof disposed and mortared between the cylindrical sidewalls 22 and 24 of the circular groove 20 of the base member 16.

The massive base member 16 provides a strong support for the section of conduit 14 passing through the well casing 10 and the generally circular groove 20 of the base portion provides a prefabricated sturdy footing for the bottom of the well casing wall, while providing a convenient sealing means preventing seepage of water from the earth 12 surrounding the manhole well casing 10 to the interior of the casing.

Having thus described the present invention by way of a typical structural example thereof, modifications thereof will be apparent to those skilled in the art, and that which is claimed as new is as follows:

1. A manhole well comprising a vertically disposed generally cylindrical tubular casing disposed in the ground and made of superimposed courses of regularly disposed bricks, said bricks having opposite side faces converging towards the interior of said casing and said bricks being united by means of motar, an open upper end portion for said casing, a removable lid normally obturating said upper end portion, said casing having a right cylindrical portion proximate the bottom thereof and a frusto-conical portion of progressively decreasing diameter disposed between said right cylindrical portion and said upper end portion, a ladder formed of a plurality of superimposed rungs made of generally U-shaped metal rods having ends set in the mortar uniting said bricks, a precast relatively massive base member made of concrete and permanently obturating the lower end of said casing, said base member having a groove formed proximate the periphery thereof for accepting the lower end portion of said casing, and means for hermetically sealing said lower end and said base member about said groove, wherein said base member has a transverse groove disposed on the upper surface thereof, said transverse groove forming a saddle for a conduit disposed therein and projecting across said casing and wherein said casing is provided on its exterior surface with a coating of mortar extending to and engaged with said base member for forming at least in part said means for hermetically sealing said lower end of said casing and said base member about said groove.

2. The manhole well of claim 1 wherein said base member is substantially circular, and said groove disposed on said upper surface is also substantially circular.

* * * * *